US005446449A

United States Patent [19]

Lhomer et al.

[11] Patent Number: 5,446,449

[45] Date of Patent: Aug. 29, 1995

[54] SYSTEM FOR MONITORING FLUID DISTRIBUTION TOWARDS A UTILIZATION STATION

[75] Inventors: Gérard Lhomer, Le Mesnil Saint Denis; Gilbert Theurant, Vitry sur Seine, both of France

[73] Assignee: Taema, Antony, France

[21] Appl. No.: 78,029

[22] Filed: Jun. 18, 1993

[30] Foreign Application Priority Data

Jun. 19, 1992 [FR] France ..... 92 07485

[51] Int. Cl.[6] ..... G08B 21/00

[52] U.S. Cl. ..... 340/611; 340/603; 340/606; 128/202.22; 128/205.23; 137/554; 137/557

[58] Field of Search ..... 340/603, 606, 611; 128/202.22, 205.23; 137/554, 557

[56] References Cited

U.S. PATENT DOCUMENTS

| | | | |
|---|---|---|---|
| 3,957,044 | 5/1976 | Fletcher et al. | 128/202.22 |
| 4,176,617 | 12/1979 | Pilipski | 128/202.22 |
| 5,057,822 | 10/1991 | Hoffman | 340/611 |
| 5,315,294 | 5/1994 | Toth | 340/611 |

*Primary Examiner*—John K. Peng
*Assistant Examiner*—Edward Lefkowitz
*Attorney, Agent, or Firm*—Browdy and Neimark

[57] ABSTRACT

A monitoring system comprising at least, a first and a second indicator unit each associated with at least one fluid distribution line and each including at least two series of indicators, each series being associated with at least one pick-up of the magnitude of a fluid which circulates in a distribution line and comprising at least two indicator lights for the thresholds of the magnitude, wherein the thresholds may be adjusted by a programming unit.

19 Claims, 1 Drawing Sheet

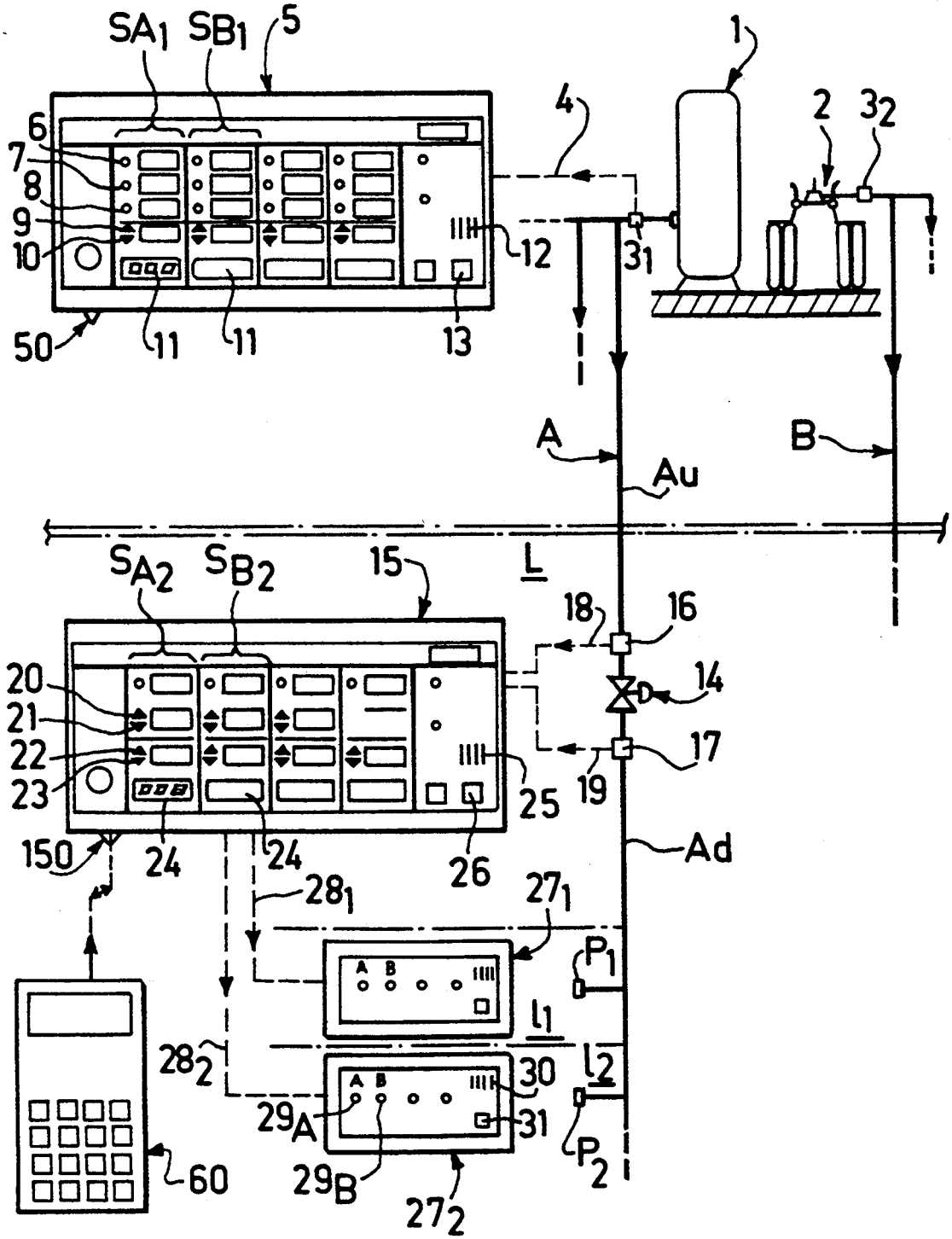
SA1
SB1
5
1
4
2
32
6
7
8
9
10
12
31
50
11
11
13
A
B
Au
L
SA2
SB2
15
18
16
14
20
21
22
23
17
19
25
150
24
24
26
Ad
281
271
P1
l1
282
30
l2
29A
31
29B
P2
60
272

SYSTEM FOR MONITORING FLUID DISTRIBUTION TOWARDS A UTILIZATION STATION

BACKGROUND OF INVENTION (a) Field of the Invention

The present invention concerns systems of monitoring the distribution of at least one fluid towards at least one utilization station, comprising at least one fluid distribution line provided with at least one pick-up connected to at least one associated light.

(b) Description of Prior Art

Operators of fluid distribution networks have at their disposal, for their own management, generally sophisticated monitoring systems showing a large number of parameters relative to the fluid, at various locations of the network. This is not the unit, however, with autonomous local networks nor, more generally, at the level of the final user. On the other hand, for certain applications, for example in medical or hospital sites, many gaseous fluids are distributed towards the same utilization stations where the user, for example the surgeon or the person in charge of reanimation, has an absolute need to be sure to rely on the correct supply, within pre-established norms, of the fluid (s) which he uses but without being compelled to read and above all interpret useless parameters.

SUMMARY OF INVENTION

It is therefore an object of the present invention to propose a monitoring system for the local distribution of at least one fluid, typically a medical fluid, of simple but efficient and reliable design, suitable for monitoring a plurality of fluids, of flexible and adaptable utilization and enabling to ensure required safety conditions.

For this purpose, according to a characteristic of the invention, the system comprises at least one indicator unit, including at least two series of indicators, each series being associated with at least one pick-up of a magnitude of a fluid in a distribution line and comprising at least two indicator lights for the threshold of said magnitude.

According to other characteristics of the invention:

- the system includes controlled access means to control each threshold;
- each series of indicators comprises a display of the value of said magnitude;
- the system comprises a first indicator unit associated with at least one pick-up disposed in the upstream part of the distribution line;
- the system comprises at least a second indicator unit associated with at least one pick-up disposed in the downstream part of the line;
- the downstream part of the line comprises a pressure reducer and two pressure pick-ups on both sides of the pressure reducer and connected to the second indicator unit which advantageously includes a series of indicators with two indicator lights for the pressure threshold upstream of the pressure reducer and two indicator lights for the pressure threshold downstream of the pressure reducer.

As used in the present invention, the term "fluid" means a fluid more particularly a gas, which circulates from a source of fluid but also a vacuum (decreased pressure of air) which circulates towards a vacuum pump.

BRIEF DESCRIPTION OF DRAWINGS

Other characteristics and advantages of the present invention will appear from the description which follows of an embodiment, given by way of illustration but without limitation, with reference to the annexed drawing, in which:

the single figure is a schematic illustration of a system of monitoring the local distribution of medical fluids according to the invention.

DESCRIPTION OF PREFERRED EMBODIMENTS

In the embodiment which is particularly illustrated in the figure, there will be seen a station for the production of medical gases, generally located in a protected enclosure, comprising for example a storage container for at least one gas, such as a container 1 for storing oxygen, bottles for storage of another gas, such as a station 2 for storing nitrogen monoxide as well as, generally, a vacuum container and a container for compressed air (not illustrated). From each source of fluid there are channels A, B, leading to at least one location L including various separate rooms or halls $\mathbf{1}_1$, $\mathbf{1}_2$, each being provided with an outlet $P_1$, $P_2$ for connecting an apparatus at each channel A, B . . . (on the figure only a portion of the distribution channel (A) from source 1 and which is decomposed into an upstream portion $A_u$ and a downstream portion $A_d$ in location L has been represented in detail).

According to an aspect of the invention, the upstream portion $A_u$ includes at least one pick-up, such as a pressure pick-up $\mathbf{3}_1$ connected by means of a line 4 to an electronic control unit with microprocessor and programmable memories (not illustrated) of a first indicator unit 5 disposed in the vicinity of sources 1 and 2. In a similar manner, unit 5 receives signals from pressure pickups disposed in the upstream parts of the other distribution lines (as indicated by pressure pick-up $\mathbf{3}_2$ in line B). Unit 5 includes a front face on which are assembled, in a plurality of series, indicators of physical magnitudes of the distributed fluids. In the illustrated example, there is a first series of indicators $S_{A1}$ associated with the fluid which circulates in line A and a second vertical series of indicators $S_{B1}$ associated with the fluid which circulates in line B. Each series of indicators $S_{X1}$ includes three lights which are indicative of the operation of the unit, respectively green 6, orange 7, red 8 and, arranged in pairs, two lights 9, indicative of maximum pressure, and 10, indicative of minimum pressure detected. Each series $S_{X1}$ advantageously includes a numerical display 11 clearly displaying the pressure which is detected by the pick-up $\mathbf{3}_i$, which is then an analog pick-up, for example a piezoelectric pressure pick-up. Unit 5 advantageously includes a sound alarm 12 which can be blinded by means of a restarter key 13 when one of the lights 7 to 10 is on, thus indicating a state of wrong operation of the source of fluid or the overloading of the maxi or mini thresholds imposed by the norms or by the operator of the network.

In location L, the lines of fluid under pressure each includes a mano-pressure reducer 14 bringing back the pressure of the fluid which is available to the stations in use to a value which is determined by the norms or the apparatuses in use. According to another aspect of the invention, in location L there is provided a second indicator unit 15 which includes an electronic control unit with microprocessor and programmable memories (not illustrated) receiving signals from at least two pressure pick-ups 16, 17 disposed on either side of the mano-pressure reducer 14 and supplying, through lines 18 and 19, to unit 15, signals indicative of the primary pressure, upstream of the pressure reducer 14, and of the secondary pressure, available at the connecting outlets $P_i$. As for the first indicator unit 5, the second indicator unit 15 includes a front face on which are grouped in series various indicators concerning the fluid which circulates in the downstream portion $A_d$ of channel A. In the embodiment which is illustrated, each series $S_{X2}$ includes a pair of lights 20, 21 which are indicative of maxi pressure and mini pressure upstream of the pressure reducer 14 (and therefore coupled to the pick-up 16) and a pair of lights 22, 23 of mini and maxi pressure available to the outlets $P_i$ (and therefore associated with pick-up 17). Advantageously, the pick-up 17 being an analog pick-up similar to pick-up $3_i$, each series $S_{X2}$ additionally includes a numerical display 24 clearly indicating the pressure which is available in the downstream portion of each channel A, B . . . Unit 15 also advantageously includes a sound alarm 25 which can be blinded by a resetting push-button 26 and which doubles, by means of a sound signal, the light signals of lights 20 to 23.

According to still another aspect of the invention, in each room $1_i$ there is provided a repetitive alarm panel $27_i$ connected by means of lines $28_i$ to unit 15 and including on its front face a light $29_X$ and a sound alarm 30, capable of being blinded by means of a resetting button 31, and activated when one of the lights 20 to 23 of the corresponding series $S_{X2}$ of unit 15 is activated.

According to an important characteristic of the invention, the first unit 5 as well as each second unit 15 includes a port 50, 150 for connection to a programming unit 60 enabling the manager of the local network, on the one hand to attribute each series of indicators $S_{Xi}$ to a particular distribution line of fluid A, B . . . or at least two series with two different significant magnitudes of a same line of fluid (for example, in addition to pressure, the flow or the content of certain impurities in the fluid), and, more generally, to control the threshold of operation of the lights 6 to 10 for unit 15 and 20 to 23 for units 15 depending on the prevailing norms or other more selective criteria to guarantee optimum conditions of use to the different stations of utilization $P_i$. Thus, for example, for medical oxygen, in France, the norms imposed, and the corresponding thresholds of units 5 and 15 will be consequently adjusted, mini and maxi pressures of 3.8 ata and 6 ata downstream of the pressure reducer 14, and 6.8 ata and 13 ata upstream of this pressure reducer 14.

Although the present invention has been described with reference to a specific embodiment, it is not limited thereto but, on the contrary, it is capable of modifications and variants which will appear to one skilled in the art. Thus, each unit 5, 15 advantageously includes an outlet for connecting to a printer and a port for connection via an interface module, to a monitoring and parameter station, possibly via a teletransmission.

We claim:

1. A fluid distribution system for delivering at least one fluid toward at least one user station, comprising at least one fluid distribution line having an upstream portion connectable to a source of said fluid, a line length and a downstream portion for fluid connection to said user station, the line length including a fluid control device for controlling a parameter of said delivered fluid and a pair of sensors on both sides of said control device for sensing said parameter upstream and downstream of said control device and providing signals indicative of said parameter, at least one first indicator unit connected to the sensors and having at least one display panel comprising at least one series of warning displays including a pair of displays indicative of under and over thresholds of the parameter sensed upstream of control device and a pair of displays indicative of under and over thresholds of the parameter sensed downstream of the control device.

2. The system of claim 1, wherein said display panel comprises a measuring display displaying a sensed value of the parameter downstream of the control device.

3. The system of claim 1, further comprising at least one second indicator unit at the user station, coupled to the first indicator unit and comprising a series of warning displays repeating the warning displays of the first indicator unit.

4. The system of claim 1, comprising a third indicator unit and an additional upstream sensor in the upstream portion of the distribution line providing a signal indicative of said parameter of said fluid in said upstream portion, the third indicator unit having at least one series of warning displays displaying values of said parameter as sensed by the upstream sensor.

5. The system of claim 1, comprising at least two said fluid distribution lines, said first indicator unit having at least two said series of warning displays, one series associated to one of said fluid distribution lines.

6. The system of claim 4, comprising at least two said fluid distribution lines, said first and third indicator units each having at least two said series of warning displays, said series of said indicator units associated to a respective one of said fluid distribution lines.

7. A system according to claim 1, wherein said fluid distribution line comprises means for carrying a medical fluid.

8. A system according to claim 2, wherein said fluid distribution line comprises means for carrying a medical fluid.

9. A system according to claim 3, wherein said fluid distribution line comprises means for carrying a medical fluid.

10. A system according to claim 4, wherein said fluid distribution line comprises means for carrying a medical fluid.

11. A system according to claim 5, wherein said fluid distribution line comprises means for carrying a medical fluid.

12. A system according to claim 6, wherein said fluid distribution line comprises means for carrying a medical fluid.

13. A fluid distribution system for delivering at least one fluid from a source of said fluid towards at least one user station, comprising:

at least one fluid distribution line, the fluid distribution line further comprising an upstream portion connectable to the source of said fluid, an intermediate line length, and a downstream portion for fluid connection to said user station;

a fluid control device in the line length for controlling a parameter of said delivered fluid;

an upstream line sensor in the line length on an upstream side of said control device for sensing said parameter upstream of said control device and providing upstream signals indicative of said parameter;

a downstream line sensor in the line length on a downstream side of said control device for sensing said parameter downstream of said control device and providing downstream signals indicative of said parameter;

at least one first indicator unit connected to the upstream line sensor and the downstream line sensor, the first indicator unit having at least one display panel including at least one first series of warning displays, the first series of warning displays including a first pair of displays indicative respectively of an under-threshold condition and an overthreshold condition of the parameter sensed upstream of the control device and a second pair of displays indicative respectively of an under-threshold condition and an overthreshold condition of the parameter sensed downstream of the control device.

14. The system according to claim 13, wherein said display panel includes a measurement display showing a quantitative value of the parameter sensed downstream of the control device.

15. The system according to claim 13, further comprising at least one second indicator unit located at the user station, the second indicator unit coupled to the first indicator unit and including a second series of warning displays repeating the first series of warning displays of the first indicator unit.

16. The system according to claim 13, comprising a third indicator unit and an additional upstream portion sensor in the upstream portion of the distribution line providing an upstream portion signal indicative of said parameter of said fluid in said upstream portion, the third indicator unit having at least one third series of warning displays displaying values of said parameter as sensed by the upstream sensor.

17. The system according to claim 16, comprising a plurality of fluid distribution lines, the first series of warning displays associated with a first of said fluid distribution lines, the third series of warning displays associated with a second of said fluid distribution lines.

18. The system according to claim 13, further comprising a plurality of fluid distribution lines, said first indicator unit including a plurality of said first series of warning displays corresponding respectively to the plurality of fluid distribution lines.

19. The system according to claim 13, wherein said fluid distribution line comprises means for carrying a medical fluid.

* * * * *